US006341614B1

(12) United States Patent
Tucker et al.

(10) Patent No.: US 6,341,614 B1
(45) Date of Patent: Jan. 29, 2002

(54) COLLAPSIBLE CANE

(76) Inventors: Robert E. Tucker, 11302 89A Avenue, Delta British Columbia (CA), V4C 7J3; Brian C. Tucker, 7775 115A Street, Delta British Columbia (CA), V4C 5R1

( * ) Notice: Subject to any disclaimer, the term of this patent is extended or adjusted under 35 U.S.C. 154(b) by 0 days.

(21) Appl. No.: 09/616,912

(22) Filed: Jul. 14, 2000

(51) Int. Cl.[7] ..... A47B 9/00

(52) U.S. Cl. ..... 135/75; 135/66; 403/109.1; 403/109.2; 403/109.7

(58) Field of Search ..... 135/75, 65, 66, 135/69, 74; 403/109.1, 109.2, 109.3, 109.7

(56) References Cited

U.S. PATENT DOCUMENTS

| | | | | |
|---|---|---|---|---|
| 1,600,046 A | | 9/1926 | Goldwin | |
| 3,987,807 A | | 10/1976 | Varnell | |
| D285,861 S | | 9/1986 | Jackson | |
| 4,887,625 A | | 12/1989 | Archer | |
| 5,139,040 A | | 8/1992 | Kelly | |
| 5,482,070 A | | 1/1996 | Kelly | |
| 5,775,352 A | * | 7/1998 | Obits | 135/75 X |
| 5,778,914 A | * | 7/1998 | Wani | 135/66 |

* cited by examiner

*Primary Examiner*—Robert W. Gibson, Jr.

(57) ABSTRACT

A collapsible cane for aiding a user to walk. The collapsible cane includes an elongate member. The elongate member has a plurality of tubular members. The tubular members include a plurality of intermediate tubular members extending between a first tubular member and a second tubular member. The elongate member is telescoping. A handle means for carrying the elongate member includes a housing, which is coupled to the first tubular member. An extension system selectively secures the elongate member in an extended position. The extension system comprises a plurality of locking pins. The locking pins are adapted to selectively lock a tubular member in a fixed position with relation to an adjacent tubular member. A draw line is coupled to the locking pins and is adapted to selectively remove the locking pins and unlock a tubular member from the fixed position.

11 Claims, 6 Drawing Sheets

FIG.7
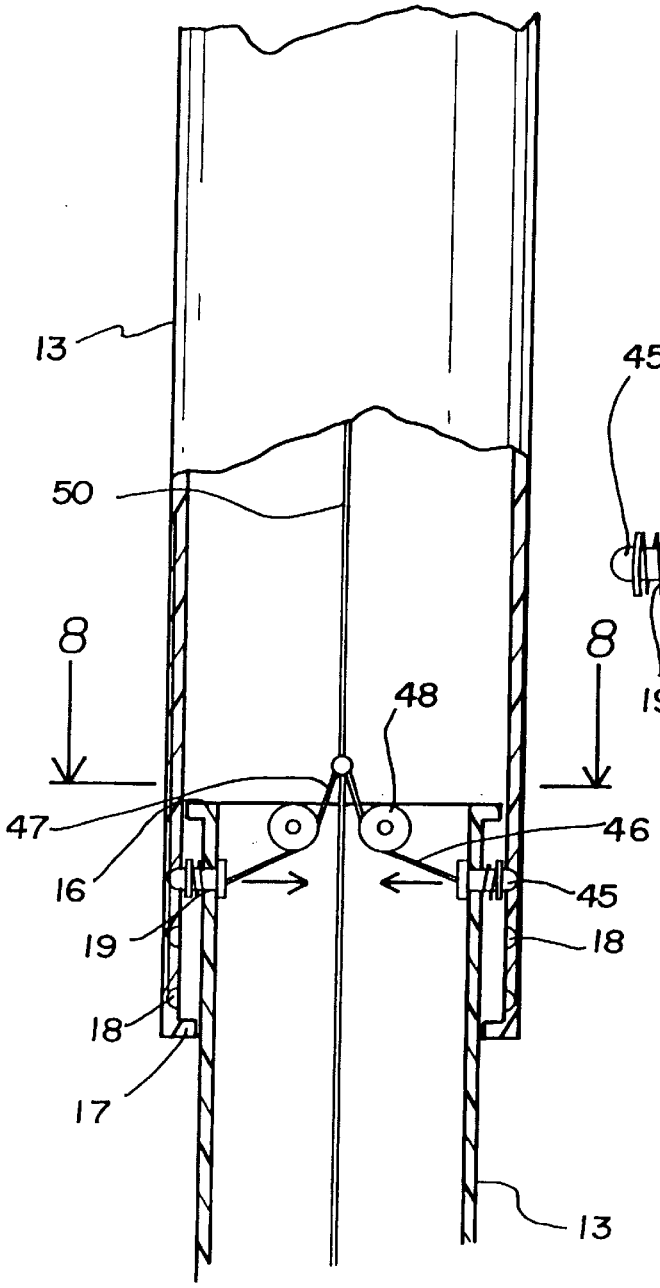
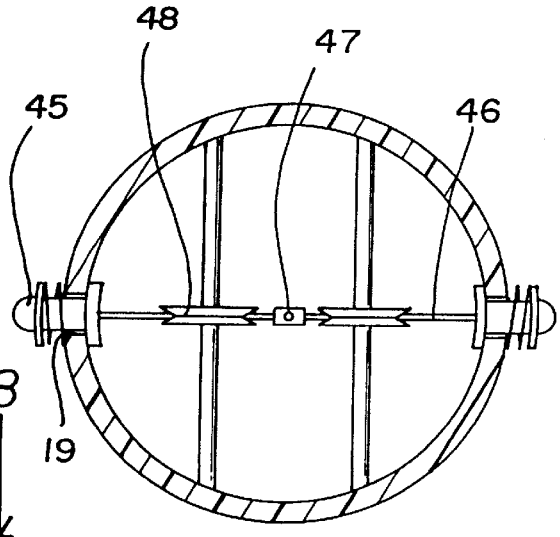
FIG.8

COLLAPSIBLE CANE

BACKGROUND OF THE INVENTION

1. Field of the Invention

The present invention relates to cane devices and more particularly pertains to a new collapsible cane for aiding a user to walk.

2. Description of the Prior Art

The use of cane devices is known in the prior art. More specifically, cane devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,139,040; U.S. Pat. No. 5,482,070; U.S. Pat. No. 3,987,807; U.S. Pat. No. 1,600,046; U.S. Pat. No. 4,887,625; and U.S. Des. Pat. No. 285,861.

While these devices fulfill their respective, particular objectives and requirements, the aforementioned patents do not disclose a new collapsible cane. The inventive device includes an elongate member. The elongate member has a plurality of tubular members. The tubular members include a plurality of intermediate tubular members extending between a first tubular member and a second tubular member. The elongate member is telescoping. A handle means for carrying the elongate member includes a housing, which is coupled to the first tubular member. An extension system selectively secures the elongate member in an extended position. The extension system comprises a plurality of locking pins. The locking pins are adapted to selectively lock a tubular member in a fixed position with relation to an adjacent tubular member. A draw line is coupled to the locking pins and is adapted to selectively remove the locking pins and unlock a tubular member from the fixed position.

In these respects, the collapsible cane according to the present invention substantially departs from the conventional concepts and designs of the prior art, and in so doing provides an apparatus primarily developed for the purpose of aiding a user to walk.

SUMMARY OF THE INVENTION

In view of the foregoing disadvantages inherent in the known types of cane devices now present in the prior art, the present invention provides a new collapsible cane construction wherein the same can be utilized for aiding a user to walk.

The general purpose of the present invention, which will be described subsequently in greater detail, is to provide a new collapsible cane apparatus and method which has many of the advantages of the cane devices mentioned heretofore and many novel features that result in a new collapsible cane which is not anticipated, rendered obvious, suggested, or even implied by any of the prior art cane devices, either alone or in any combination thereof.

To attain this, the present invention generally comprises an elongate member. The elongate member has a plurality of tubular members. The tubular members include a plurality of intermediate tubular members extending between a first tubular member and a second tubular member. The elongate member is telescoping. A handle means for carrying the elongate member includes a housing, which is coupled to the first tubular member. An extension system selectively secures the elongate member in an extended position. The extension system comprises a plurality of locking pins. The locking pins are adapted to selectively lock a tubular member in a fixed position with relation to an adjacent tubular member. A draw line is coupled to the locking pins and is adapted to selectively remove the locking pins and unlock a tubular member from the fixed position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new collapsible cane apparatus and method which has many of the advantages of the cane devices mentioned heretofore and many novel features that result in a new collapsible cane which is not anticipated, rendered obvious, suggested, or even implied by any of the prior art cane devices, either alone or in any combination thereof.

It is another object of the present invention to provide a new collapsible cane which may be easily and efficiently manufactured and marketed.

It is a further object of the present invention to provide a new collapsible cane which is of a durable and reliable construction.

An even further object of the present invention is to provide a new collapsible cane which is susceptible of a low cost of manufacture with regard to both materials and labor, and which accordingly is then susceptible of low prices of sale to the consuming public, thereby making such collapsible cane economically available to the buying public.

Still yet another object of the present invention is to provide a new collapsible cane which provides in the apparatuses and methods of the prior art some of the advantages thereof, while simultaneously overcoming some of the disadvantages normally associated therewith.

Still another object of the present invention is to provide a new collapsible cane for aiding a user to walk.

Yet another object of the present invention is to provide a new collapsible cane which includes an elongate member. The elongate member has a plurality of tubular members. The tubular members include a plurality of intermediate tubular members extending between a first tubular member and a second tubular member. The elongate member is telescoping. A handle means for carrying the elongate member includes a housing, which is coupled to the first tubular member. An extension system selectively secures the elongate member in an extended position. The extension system comprises a plurality of locking pins. The locking pins are adapted to selectively lock a tubular member in a fixed position with relation to an adjacent tubular member. A draw line is coupled to the locking pins and is adapted to selectively remove the locking pins and unlock a tubular member from the fixed position.

Still yet another object of the present invention is to provide a new collapsible cane that may be adjusted to varying lengths.

Even still another object of the present invention is to provide a new collapsible cane that may be easily stored and carried in its compact form.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a schematic side view of the present invention.

FIG. 8 is a schematic cross-sectional view taken along line 8—8 of the present invention.

DESCRIPTION OF THE PREFERRED EMBODIMENT

Figure 1:
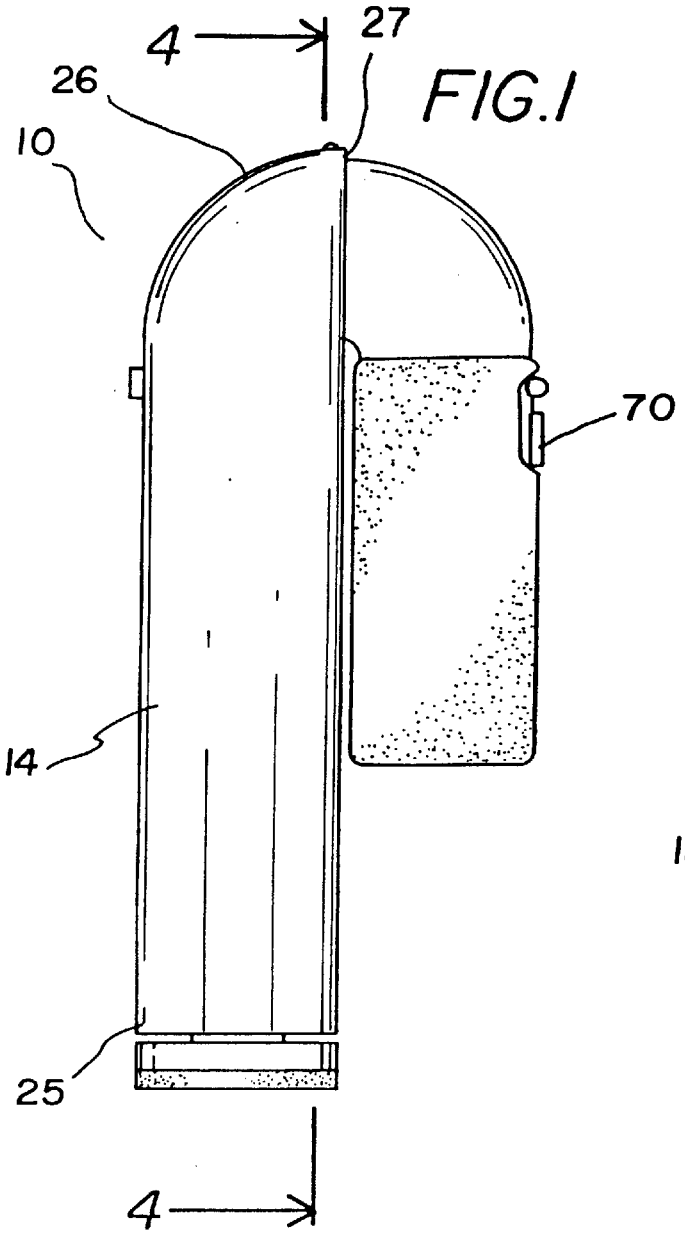
FIG. 1 is a schematic side view of a new collapsible cane in a collapsed position according to the present invention.

With reference now to the drawings, and in particular to FIG. 1 through thereof, a new collapsible cane embodying the principles and concepts of the present invention and generally designated by the reference numeral 10 will be described.

As best illustrated in FIGS. 1 through 11, the collapsible cane 10 generally comprises an elongate member 12 which forms the body of a telescoping cane.

The elongate member 12 contains a plurality of tubular members. The tubular members include a plurality of intermediate tubular members 13 extending between a first tubular member 14 and a second tubular member 15. Each of the intermediate tubular members 13 is slidably insertable into the first tubular member 14, and the second tubular member 15 is slidably insertable into an adjacent intermediate tubular member 13.

Each of the intermediate tubular members 13 comprises a first end 16 and a second end 17 such that the first end 16 extends toward the first tubular member 14. The first end 16 has an annular shoulder coupled thereto and extending away from the intermediate tubular member, the second end 17 has an annular shoulder coupled thereto and extending toward a central portion of the tubular elongate member. Though not needed, as will be seen, the shoulders of adjacent tubular members aid in the stability of the elongate member by limiting their movement past each other. An inner surface has a plurality of pairs of opposing notches 18 therein. Each of the notches 18 is positioned along a line between the first 16 and second 17 ends. The pairs of notches 18 are located nearer the second end 17. The inner surface has a pair of opposed bores 19. The bores 19 are generally adjacent to the first end 16.

Figure 9:
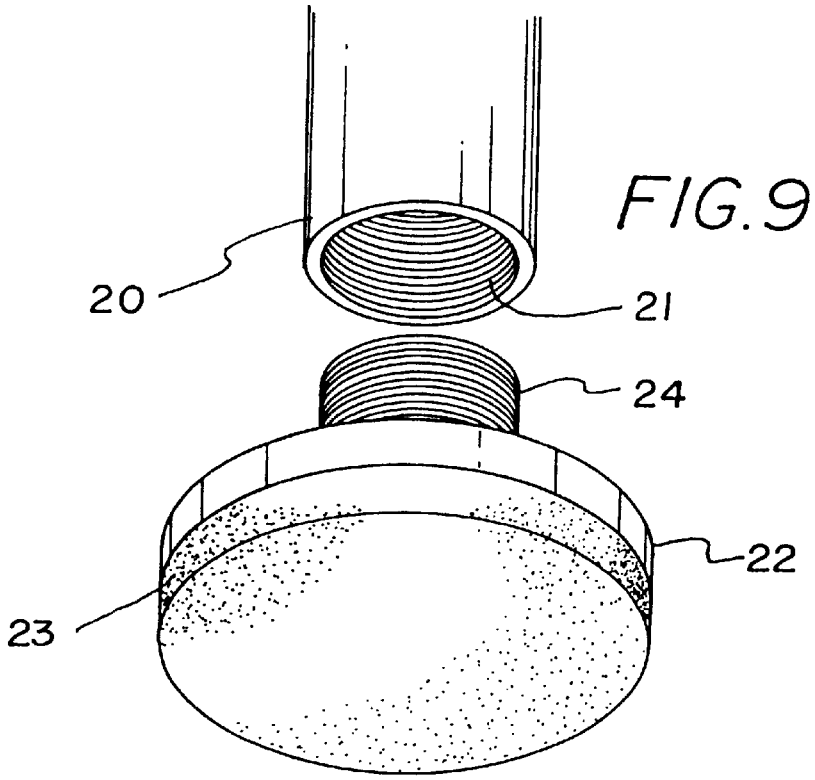
FIG. 9 is a schematic perspective view of the base portion of the present invention.
Figure 10:
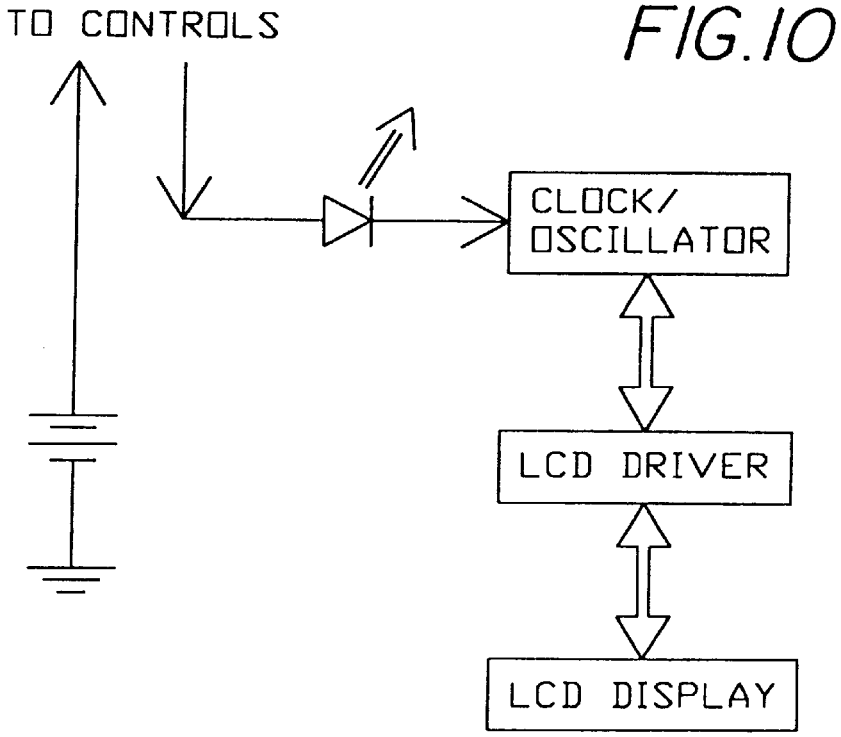
FIG. 10 is a electronic schematic of the present invention.
Figure 11:
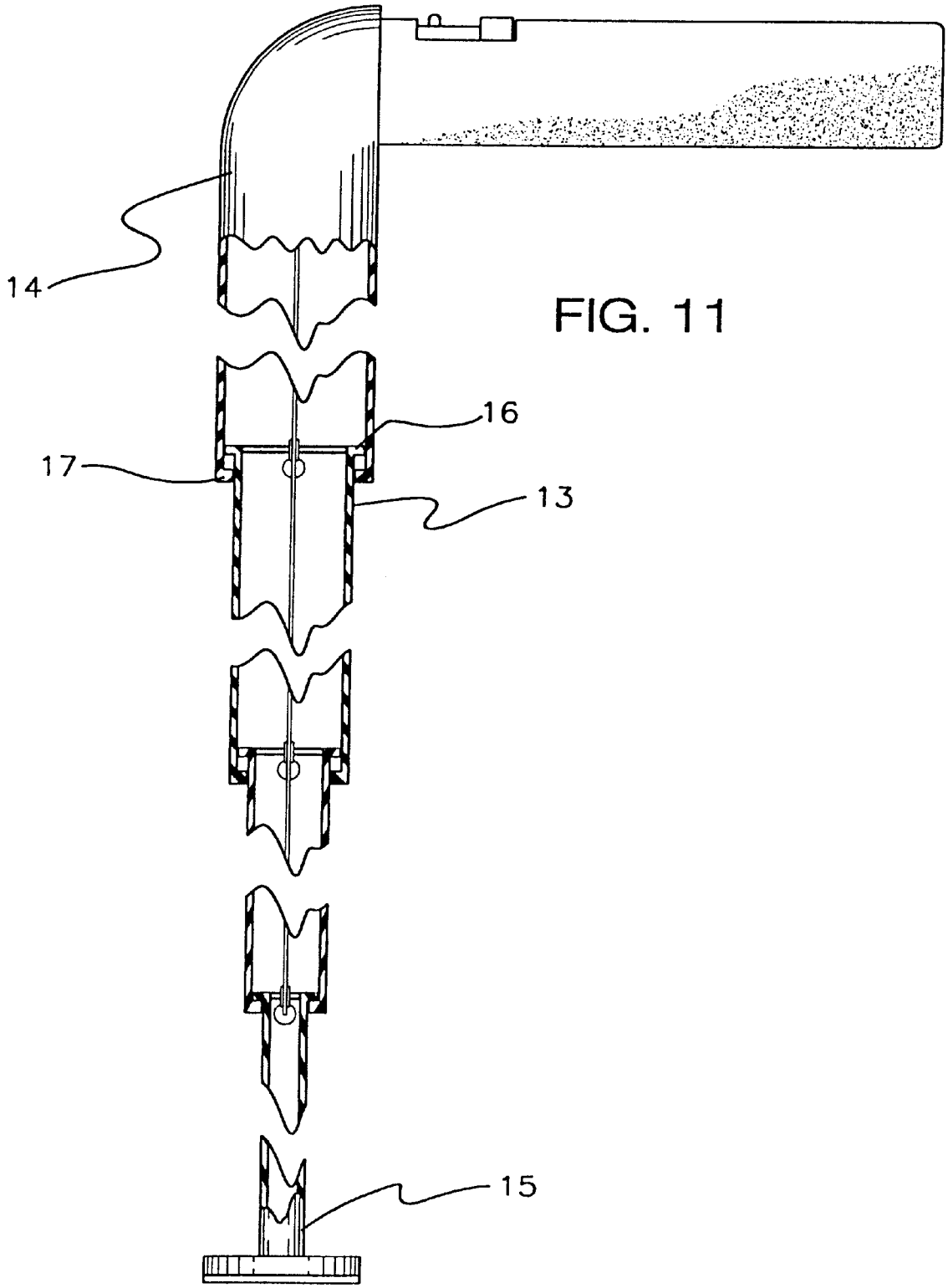
FIG. 11 is a schematic side view of the present invention.

The second tubular member 15 has a first end, which is generally identical to the first end of the intermediate tubular members, and a second end 20. The first end has an annular shoulder coupled thereto which extends away from the second tubular member. A pair of opposing bores 19 extends through the second tubular member and is positioned generally adjacent to the first end as in the intermediate tubular members. The second end 20 of the second tubular member 16 has an inside surface which is threaded 21. Base portions 22 may be inserted into the second end 20 as is shown in FIG. 9. The base portion 22 may have a rough bottom surface, an elastomeric surface, or a surface with teeth therein depending on the need of the user. The base portion 22 in FIG. 9 comprises a disc 23 having a threaded lug 24 thereon for removably inserting into the second end 20 of the second tubular member 15. The disc 23 may be comprised of multiple layers of elastomeric material. An inner layer, not shown, positioned generally adjacent to the lug 24 would have a different color from outside layers. When the outside layers wear down, the color from the inner layer would be apparent and would signal that a the base portion 22 should be replaced.

The first tubular member 14 has a first end 26 and a second end 25. The second end 25, which is generally identical to the second ends of the intermediate tubular members, has an annular shoulder coupled thereto extends towards a central portion of the first tubular member. The first end 26 is domed. An opening 27 extends into a peripheral wall of the first tubular member 14 and is located generally adjacent to the first end 26.

Figure 2:
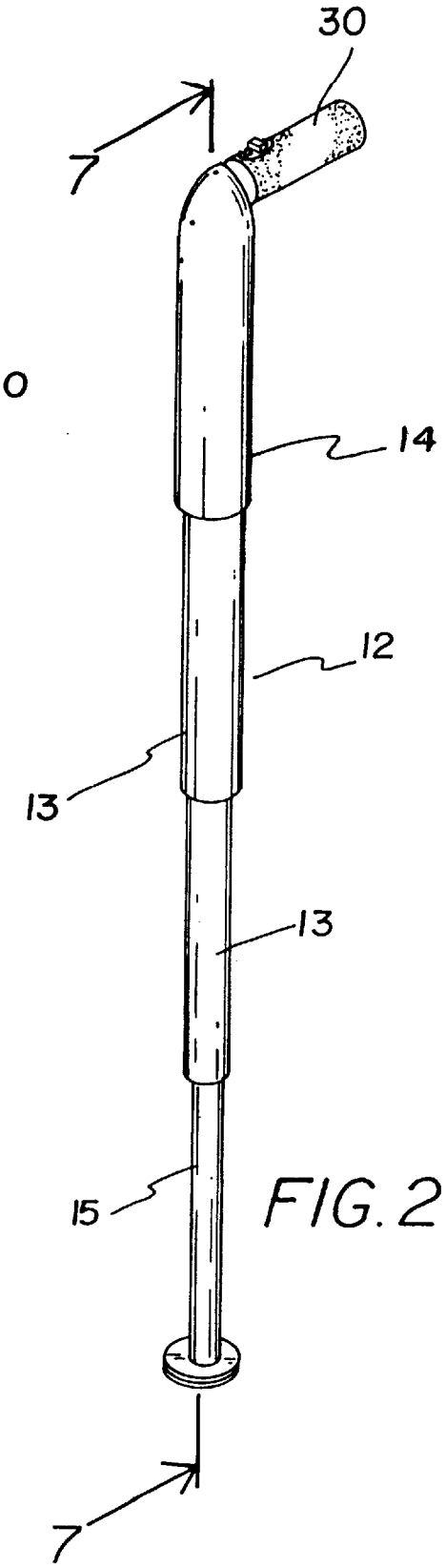
FIG. 2 is a schematic perspective view of the present invention in an extended position.
Figure 3:
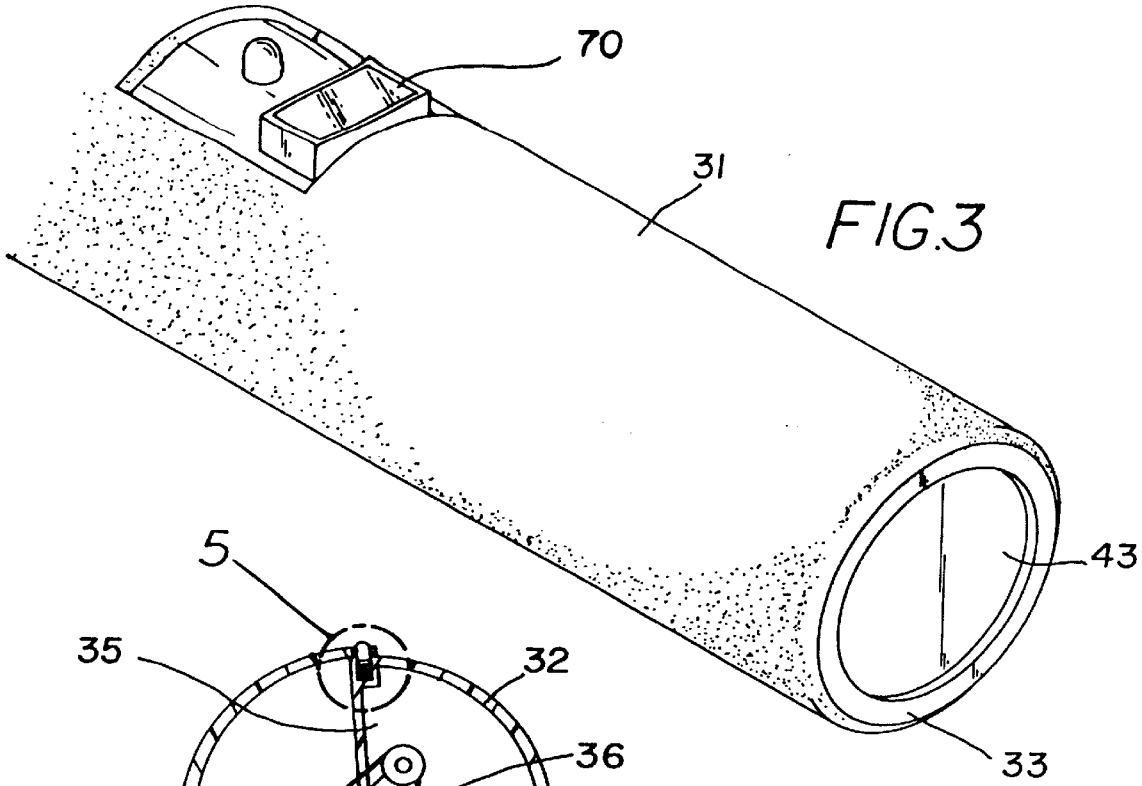
FIG. 3 is a schematic perspective view of the housing of the present invention.
Figure 4:
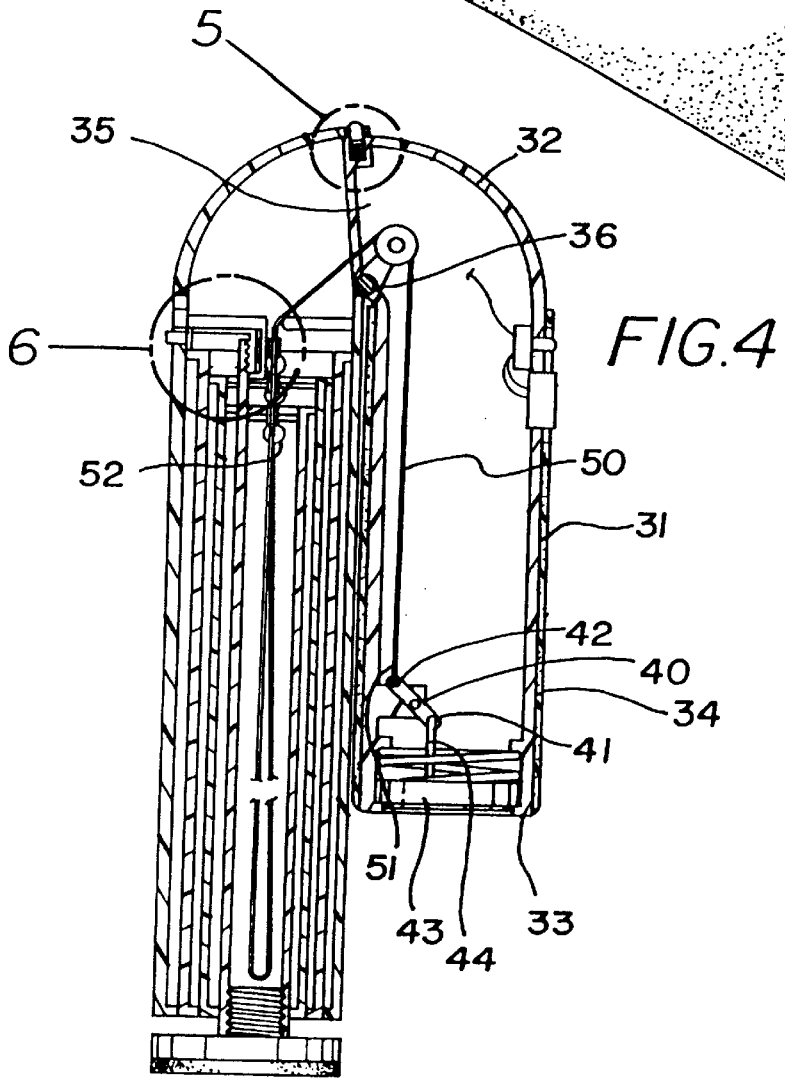
FIG. 4 is a schematic cross-sectional view taken alone line 4—4 of the present invention.
Figure 5:
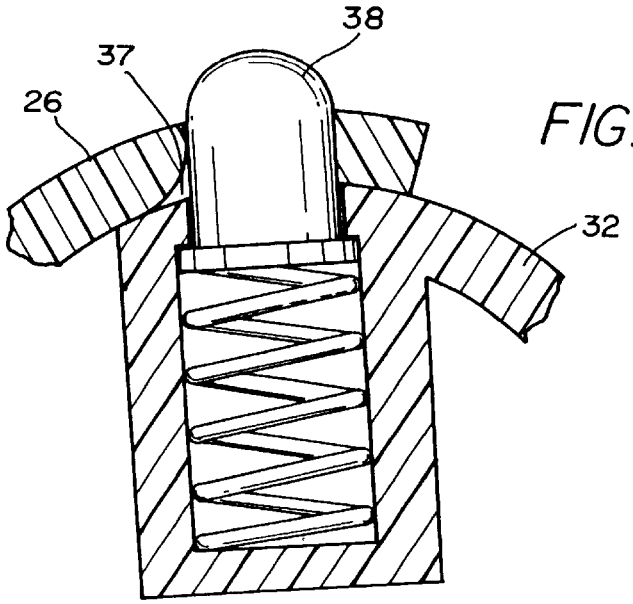
FIG. 5 is a schematic cross-sectional view of area 5 in FIG. 4 of the present invention.
Figure 6:
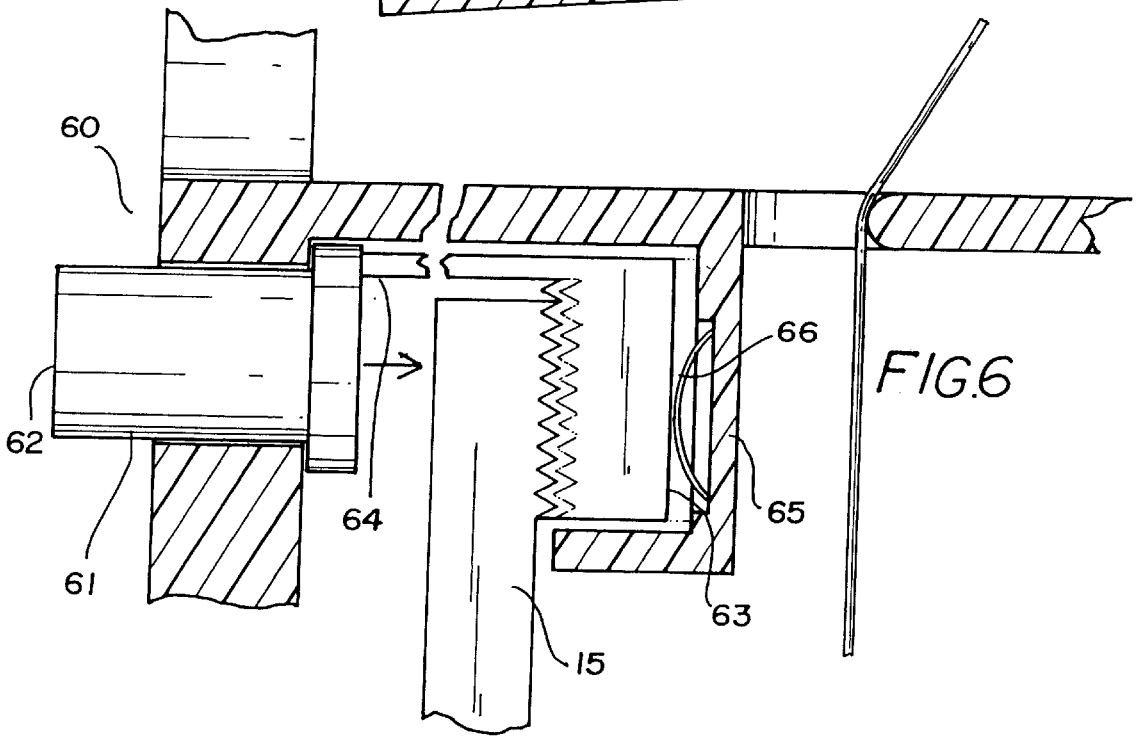
FIG. 6 is a schematic cross-sectional view of area 6 in FIG. 4 of the present invention.

A handle means 30 for carrying the elongate member 12 is coupled to the elongate member 12 and can preferably be moved between a retracted position as shown in FIG. 1, or an extended position as shown in FIG. 2.

The handle means 30 includes a housing 31 having a distal end 32, a proximal end 33 and peripheral wall 34 extending therebetween. The housing 31 is generally hollow. The peripheral wall 34 has an opening 35 therein located generally adjacently to the distal end 32. The distal end 32 has a rounded surface. An axle 36 hingedly couples the handle means 31 to the first tubular member 14. The axle 36 is positioned generally adjacent to the opening 35 in the housing 31 and the opening 27 in the first tubular member 14 such that the distal end 32 of the housing 31 may be rotatably inserted into the opening 27 in the tubular member 14 to define the extended position. The housing 31 is selectively movable to the retracted position, which is defined by the peripheral wall 34 of the housing 31 being substantially adjacent to the peripheral wall of the first tubular member 14.

A locking means selectively locks the handle in the retracted position. The locking means comprises a bore 37 in the first tubular member 14 and a button 38 in the housing 31. The bore 37 is located generally adjacent to the opening 27. The button 38 is slidably mounted in the distal end 32 of the housing 31. The button 38 is biased such that a portion of the button 38 extends outwardly away from the distal end 32 of the housing 31. The button 38 is positioned such that the button 38 extends through the bore 37 in the first tubular means 14 when the housing 31 is in the retracted position.

An extension system selectively secures the elongate member 12 in an extended position, as shown in FIG. 2. When actuated, the release system allows the varying tubular members to slide into one another such that a compacted elongate member is obtained as shown in FIG. 1.

The extension system has a lever 40, which is hingedly mounted in the housing 31 such that the ends 41, 42 of the lever 40 selectively move away and towards the proximal end 33 of the housing 31.

An actuating means comprises a button 43, which is slidably mounted in the proximal end 33 of the housing 31. The button 43 is biased in a direction away from the distal end 32 of the housing 31.

A rod 44 is coupled to and extends between a first end 41 of the lever 40 and the button 43. When the user presses the button 43 inward the housing 31, the rod 44 lifts the first end 41 of the lever 40 causing the second end 42 of the lever 40 to move toward the button 43.

Locking pins 45 are slidably mounted in each one of the opposing bores 19 in the tubular members such that one pair of locking pins 45 is located in each of the tubular members. Each of the locking pins 45 is biased to extend outwardly away from the tubular members and into the notches 18 in the tubular members.

A plurality of connecting lines 46 connects each one of a pair of locking pins 45 to the other of a pair of locking pins 45. Each of the lines 46 has an end fixedly coupled to one locking pin, and each of the lines 46 has a middle section 47.

A plurality of pulley wheels 48 is rotatably mounted between each of the pairs of locking pins 45. Each of a pair of the pulley wheels is on an opposite side of a central point of the connecting lines 46. Each of the pulley wheels 48 is orientated such that each of the connecting lines 46 is orientated generally parallel to a rotational axis of the pulley wheels 48. Each pair of the pulley wheels 48 is located generally between the first end 16 of the tubular members and the locking pins 45.

A draw line 50 draws, or pulls, the connecting lines 48 toward the housing 31. The draw line 50 has a first end 51 and a second end 52. The first end 51 is coupled to a second end 41 of the lever 40, and the second end 52 is fixedly coupled to the second tubular member 15. A length of the draw line 50 extending between the first 51 and second 52 ends extends through the intermediate tubular members 13. The draw line is coupled to the middle section 47 of each of the connecting lines 46. The draw line 50 is generally taut when the elongate member 12 is in an extended position such that the connecting lines 46 are pulled upwardly and against the pulley wheels 48 as best depicted in FIG. 7. Pressing the button 43 in the housing causes draw line 50 to pull on the locking pins 45 and slidably move them away from the notches 18. When the locking pins 45 are removed from the notches 18, the tubular members may be slid together. The cane may have differing lengths by allowing the locking pins 45 access into different notches 18.

A securing means 60 secures the elongate member 12 in a retracted and compact position as shown in FIG. 1. The securing means 60 includes a rod 61. The rod 61 slidably extends into the first tubular member 14. The rod 61 has a first end 62 and a second end 63. The rod 61 has a depression 64 therein generally located between the first 62 and second 63 ends. The first end 62 is located outside of the first tubular member 14. The second end 63 is generally adjacent to a wall 65. A biasing means 66 is generally positioned between the second end 63 and the wall 65 and biases the rod 61 away from the wall 65 such that the rod 61 extends to its position outside of the first tubular member 14. The depression 64 is positioned such that depression 64 may receive a portion of the second tubular member 15. The depression 64 has a roughened surface and an inner surface of the second tubular member 16 located generally adjacent to its first end is roughened. As the rod 61 is biased outward, the depression 64 presses against the second tubular member 15. The friction caused between them secures the second tubular member 15 in the depression 64. Exerting force on the first end 62 of the rod 61 releases the second tubular member 15 from the depression 64.

Ideally, the apparatus includes a means for displaying time 70. The means for displaying time comprises a microprocessor adapted for tracking time and a display panel for displaying information from the microprocessor. The display is mounted in the housing and is generally flush with the peripheral wall of the housing. The display panel is operationally coupled to the microprocessor, and ideally comprises a liquid crystal display. A power supply is operationally coupled to the microprocessor. The power supply is ideally a battery mounted in the housing.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A collapsible cane apparatus, said apparatus comprising:

an elongate member, said elongate member comprising:

a plurality of tubular members, said tubular members comprises a plurality of intermediate tubular members extending between a first tubular member and a second tubular member, said elongate member being telescoping;

a handle means for carrying said elongate member, said handle means comprising:

a housing being coupled to said first tubular member;

an extension system for selectively securing said elongate member in an extended position, said extension system comprising:

a plurality of locking pins, said locking pins being adapted to selectively lock a tubular member in a fixed position with relation to an adjacent tubular member; and a draw line, said draw line being coupled to said locking pins and being adapted to selectively remove said locking pins and unlock a tubular member from said fixed position.

2. The collapsible cane apparatus as in claim 1, wherein each of said intermediate members comprises:

a first end and a second end such that said first end extends toward said first tubular member, an inner surface having a plurality of pairs of opposing notches therein for receiving said locking pins from another tubular member, each of said notches being positioned along a line between said first and second ends, each of said pairs of notches being located nearer said second end, said inner surface having a pair of opposed bores for slidably mounting said locking pins such that one locking pin is in each bore, said bores being generally adjacent to said first end.

3. The collapsible cane apparatus as in claim 2, wherein said second tubular member comprises:

a first end and a second end, a pair of opposing bores extending through said second tubular member and being positioned generally adjacent to said first end for slidably mounting said locking pins, said second end of said second tubular member having an inside surface being threaded, a base portion having a threaded lug thereon may be removably inserted into said second end of said second tubular member.

4. The collapsible cane apparatus as in claim 3, wherein said first tubular member comprises:

wherein said first tubular member has a first end and a second end, said first end being domed, an opening extending into a peripheral wall of said first tubular member being located generally adjacent to said first end, said handle means being coupled to said opening.

5. The collapsible cane apparatus as in claim 4, wherein said housing further comprises:

said housing having a distal end, a proximal end and peripheral wall extending therebetween, said housing being generally hollow, said peripheral wall having an opening therein located generally adjacently to said distal end, said distal end having, a rounded surface, said handle being hingedly coupled to said first tubular member by an axle, said axle being positioned generally adjacent to said opening in said housing and said opening in said first tubular member such that said distal end of said housing may be rotatably inserted into said opening in said tubular member to define an extended position, said housing being selectively movable to a retracted position defined by said peripheral wall of said housing being substantially adjacent to said peripheral wall of said first tubular member.

6. The collapsible cane apparatus as in claim 5, said handle means further comprising:

a locking means for selectively locking said handle in said retracted position, said locking means comprising a bore in said first tubular member and a button in said housing, said bore being located generally adjacent to said opening, said button being slidably mounted in said distal end of said housing, said button being biased such that a portion of said button extends outwardly away from said distal end of said housing, said button being positioned such that said button extends through said bore in said first tubular means when said housing is in said retracted position.

7. The collapsible cane apparatus as in claim 5, said extension system further comprising:

a lever, said lever being hingedly mounted in said housing such that the ends of said lever selectively move away and towards said proximal end of said housing;

an actuating means, said actuating means comprising a button, said button being slidably mounted in said proximal end of said housing, said button being biased away from said distal end of said housing;

a rod, said rod being coupled to and extending between a first end of said lever and said button; and wherein an end of said draw line is coupled to said second end of said lever.

8. The collapsible cane apparatus as in claim 7, wherein said extension system further comprises:

a plurality of connecting lines for connecting each one of a pair of locking pins to the other of a pair of locking pins, each of said connecting lines having an end fixedly coupled to one locking pin, each of said connecting lines having a middle section, a pulley wheel being rotatably mounted to on either side of a central point of each of said connecting lines; and said draw line being coupled to said middle sections of each of said draw lines.

9. The collapsible cane apparatus as in claim 4, further comprising:

a securing means for securing said elongate member in a retracted position, said securing, means comprising:

a rod, said rod slidably extending into said first tubular member, said rod having a first and second end, said rod having a depression adapted for receiving a portion of the first end of said second tubular member, said rod being biased to extend away from an internal portion of said first tubular member such that said notch is biased against said second tubular member, wherein exerting force on an external portion of said rod releases said second tubular member from said depression.

10. A collapsible cane apparatus, said apparatus comprising:

an elongate member, said elongate member comprising:

a plurality of tubular members, said tubular members comprise a plurality of intermediate tubular members extending between a first tubular member and a second tubular member, said elongate member being telescoping such that each of said intermediate tubular members is slidably insertable into said first tubular member, said second tubular member being slidably insertable into an adjacent intermediate tubular member;

wherein each of said intermediate tubular members having a first end and a second end such that said first end extends toward said first tubular member, said first end having an annular shoulder coupled thereto and extending away from said intermediate tubular member, said second end having an annular shoulder coupled thereto and extending toward a central portion of said tubular elongate member, an inner surface having a plurality of pairs of opposing notches therein, each of said notches being positioned along a line between said first and second ends, each of said pairs of notches being located nearer said second end, said inner surface having a pair of opposed bores, said bores being generally adjacent to said first end;

wherein said second tubular member has a first end and a second end, said first end having an annular shoulder coupled thereto and extending away from said second tubular member, a pair of opposing bores extending through said second tubular member and being positioned generally adjacent to said first end, said second end of said second tubular member having an inside surface being threaded, a base portion comprising a disc having a threaded lug thereon may be removably inserted into said second end of said second tubular member;

wherein said first tubular member has a first end and a second end, said second end having an annular shoulder coupled thereto and extending towards a central portion of said first tubular member, said first end being domed, an opening extending into a peripheral wall of said first tubular member being located generally adjacent to said first end;

a handle means for carrying said elongate member, said handle means comprising:

a housing having a distal end, a proximal end and peripheral wall extending therebetween, said housing being generally hollow, said peripheral wall having an opening therein located generally adjacently to said distal end, said distal end having a rounded surface, said handle being hingedly coupled to said first tubular member by an axle, said axle being positioned generally adjacent to said opening in said housing and said opening in said first tubular member such that said distal end of said housing may be rotatably inserted into said opening in said tubular member to define an extended position, said housing being selectively movable to a retracted position defined by said peripheral wall of said housing being substantially adjacent to said peripheral wall of said first tubular member;

a locking means for selectively locking said handle in said retracted position, said locking means comprising a bore in said first tubular member and a button in said housing, said bore being located generally adjacent to said opening, said button being slidably mounted in said distal end of said housing, said button being biased such that a portion of said button extends outwardly away from said distal end of said housing, said button being positioned such that said button extends through said bore in said first tubular means when said housing is in said retracted position;

an extension system for selectively securing said elongate member in an extended position, said extension system comprising:

a lever, said lever being hingedly mounted in said housing such that the ends of said lever selectively move away and towards said proximal end of said housing;

an actuating means, said actuating means comprising a button, said button being slidably mounted in said proximal end of said housing, said button being biased away from said distal end of said housing;

a rod, said rod being coupled to and extending between a first end of said lever and said button;

a plurality of locking pins, each of said locking pins being slidably mounted in one of said opposing bores in said tubular members such that one pair of locking pins is located in each of said tubular members, each of said locking pins being biased to extend outwardly away from said tubular members, said locking pins extending into said notches in said tubular members;

a plurality of connecting lines for connecting each one of a pair of locking pins to the other of a pair of locking pins, each of said connecting lines having an end fixedly coupled to one locking pin, each of said connecting lines having a middle section;

a plurality of pulley wheels, a pair of said pulley wheels being rotatably mounted between each of said pairs of locking pins, each of said pulley wheels in a pair of pulley wheels being on an opposite side of a central point of said connecting lines, each of said pulley wheels being orientated such that each of said connecting lines are orientated generally parallel to a rotational axis of said pulley wheels, each pair of said pulley wheels being located generally between the first end of the tubular member and said locking pins;

a draw line for drawing said connecting lines toward said housing, said draw line having a first end and a second end, said first end being coupled to a second end of said lever, said second end being fixedly coupled to said second tubular member, a length of said draw line extending between said first and second ends extending through said intermediate tubular members, said draw line being coupled to said middle section of each of said connecting lines, wherein said draw line is generally taut when said elongate member is in an extended position, wherein pressing said button in said housing causes said locking pins to be slidably moved away from said notches;

a securing means for securing said elongate member in a retracted position, said securing means comprising:

a rod, said rod slidably extending into said first tubular member, said rod having a first end and a second end, said rod having a depression therein generally located between said first and second ends, said first end being positioned outside of said first tubular member, said second being generally adjacent to a wall, a biasing means for biasing said rod in a first direction being generally positioned between said second end and said wall, said biasing means biases said rod away from said wall, said depression being positioned such that depression may receive a portion of said second tubular member, said depression having a roughened surface and an inner surface of said second tubular member located generally adjacent to said first end being roughened, wherein exerting force on said first end of said rod releases said second tubular member from said depression.

11. The collapsible cane apparatus as in claim 10, further comprising:

a means for displaying time, said means for displaying time comprising:

a microprocessor adapted for tracking time;

a display panel for displaying information from said microprocessor, said display being mounted in said housing and being generally flush with said peripheral wall of said housing, said display panel being operationally coupled to said microprocessor; and a power supply, said power supply being operationally coupled to said microprocessor, said power supply being a battery.

* * * * *